US007966838B2

(12) United States Patent
Lifson et al.

(10) Patent No.: US 7,966,838 B2
(45) Date of Patent: Jun. 28, 2011

(54) SUCTION MODULATION VALVE FOR REFRIGERANT SYSTEM WITH ADJUSTABLE OPENING FOR PULSE WIDTH MODULATION CONTROL

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 301 days.

(21) Appl. No.: 12/443,720

(22) PCT Filed: Dec. 21, 2006

(86) PCT No.: PCT/US2006/049002

§ 371 (c)(1),
(2), (4) Date: Mar. 31, 2009

(87) PCT Pub. No.: WO2008/076121

PCT Pub. Date: Jun. 26, 2008

(65) Prior Publication Data

US 2010/0095693 A1 Apr. 22, 2010

(51) Int. Cl.
*F25B 41/04* (2006.01)
*F25B 49/00* (2006.01)

(52) U.S. Cl. ..... 62/217; 62/228.3

(58) Field of Classification Search ..... 62/217, 62/222, 228.1, 228.3; 417/26, 44.2, 295
See application file for complete search history.

(56) References Cited

U.S. PATENT DOCUMENTS

| | | | | |
|---|---|---|---|---|
| 6,227,812 | B1 | 5/2001 | Kawaguchi et al. | |
| 2008/0250801 | A1 * | 10/2008 | Lifson et al. | 62/216 |
| 2009/0205349 | A1 * | 8/2009 | Lifson et al. | 62/231 |
| 2010/0011792 | A1 * | 1/2010 | Lifson et al. | 62/222 |
| 2010/0043468 | A1 * | 2/2010 | Lifson et al. | 62/196.3 |

OTHER PUBLICATIONS

Search Report and Written Opinion mailed on Oct. 4, 2007 for PCT/US2006/49002.

* cited by examiner

*Primary Examiner* — Marc E Norman
(74) *Attorney, Agent, or Firm* — Carlson, Gsakey & Olds, PC

(57) ABSTRACT

A pulse width modulation control is provided for a suction modulation valve in a refrigerant system. An intentional small "leakage" path is maintained through the suction modulation valve to ensure that the pressure inside the compressor shell does not decrease below a safe reliability threshold but, at the same time, does not exceed a certain value, which would cause the refrigerant system to operate inefficiently, when the pulse width modulation control has moved the suction modulation valve to a closed position. The size of this minimum "leakage" path is continuously adjusted to ensure that the optimum pressure inside the compressor shell is maintained regardless of the evaporator pressure and other operating conditions.

18 Claims, 2 Drawing Sheets

SUCTION MODULATION VALVE FOR REFRIGERANT SYSTEM WITH ADJUSTABLE OPENING FOR PULSE WIDTH MODULATION CONTROL

BACKGROUND OF THE INVENTION

This application relates to a refrigerant system, in which a suction modulation valve (or other type of a valve which has a small controlled opening in the closed position) is provided with pulse width modulation control to adjust refrigerant system capacity. A minimum opening size of the suction modulation valve is maintained to ensure that suction pressure inside a shell of the compressor located downstream of the suction modulation valve does not decrease below a specified value. However, this minimum opening size is adjusted in response to system operating conditions to ensure that the suction pressure within the compressor is close to the allowable minimum, and is not undesirably higher.

Refrigerant systems are known, and are utilized to condition a secondary fluid. As an example, an air conditioning system cools and dehumidifies air being delivered into a climate controlled environment. Refrigerant systems generally include a compressor compressing refrigerant and delivering that refrigerant through a discharge line to a first heat exchanger. From the first heat exchanger, refrigerant passes through an expansion device and then through a second heat exchanger. The refrigerant is then returned to the compressor.

Under various conditions, a refrigerant system may provide excess of capacity to cool or heat a secondary fluid supplied to a climate controlled environment. A number of methods are known for reducing the capacity of the refrigerant system.

One known method of reducing capacity is to provide a pulse width modulation control for a suction valve located upstream of the compressor to control the amount of refrigerant moving from the second heat exchanger to the compressor. In pulse width modulation control for a suction valve, the valve is rapidly cycled (opened and closed) to limit the amount of refrigerant flowing to the compressor. This in turn limits the refrigerant amount compressed in the compressor and refrigerant flow circulating throughout the refrigerant system, resulting in a capacity reduction for the refrigerant system, and providing more efficient operation.

One challenge with regard to such operation is that the pressure within the compressor shell must not be reduced below a specified limit defined by compressor reliability considerations. As a rough guideline, it is desirable to maintain a pressure within the compressor shell of at least 1 psia. However, when the suction modulation valve is completely closed during pulse width modulation control cycle, sometimes, the pressure within the compressor shell can decrease below this specified minimum pressure. Under such circumstances, sparking can occur at the terminals for the compressor motor, which can lead to terminal damage. This phenomenon is known as a "corona discharge" effect, and is undesirable.

Thus, it is known in the prior art to provide a minimum "leakage" opening for the suction valve, while it would be otherwise closed during pulse width modulation cycle, to prevent compressor suction from entering a deep vacuum region. Also, in another approach, a branch bypass line, containing a small internal diameter capillary tube or a small orifice, around the pulse width modulation valve has been proposed in the past to prevent compressor suction from going into deep vacuum by providing an alternate small "leakage" path for refrigerant flowing into the compressor. While the prior art does provide good control of capacity, the "leakage" opening is typically sized to ensure that the suction pressure in the compression shell exceeds the specified minimum pressure at all operating conditions.

However, the downstream pressure inside the compressor shell, when the suction valve is in the closed position, changes substantially for a constant size opening, depending on the pressure upstream of the opening. The evaporator pressure can vary by at least an order of magnitude, depending on the operating conditions of the refrigerant system. Therefore, under high pressure operating conditions at the evaporator, in the prior art, the suction pressure inside the compressor would also be much higher then what can be considered desirable for the minimum pressure in order to avoid the "corona discharge" effect. Having the suction pressure well above this threshold is undesirable, since it decreases the efficiency of the refrigerant system operating in a pulse width modulated mode. Thus, the prior art could not effectively control the suction pressure inside the compressor to be just above the acceptable threshold for all operating conditions, while at the same time avoiding the "corona discharge".

SUMMARY OF THE INVENTION

In a disclosed embodiment of this invention, a control for a suction modulation valve operates the suction modulation valve using pulse width modulation control to reduce refrigerant system capacity. When the valve is in the closed position, the control varies the size of the minimum or "leakage" opening in the valve, depending on the refrigerant system operating conditions. In a disclosed embodiment, the controlling refrigerant system operating condition would be a pressure upstream of the suction modulation valve. This pressure is typically associated with, and closely approximated by, the pressure inside the evaporator. The evaporator pressure can be measured by one of the sensors, and the registered value is related to a desired minimum opening of the suction modulation valve to achieve a minimum desired pressure within the compressor shell. As known, the smaller the opening of the valve, the larger the pressure drop through the valve, therefore, for the same upstream evaporator pressure, the downstream compressor suction pressure can be controlled by varying the size of this opening. In this manner, the prior art problem of having suction pressure far above the minimum threshold pressure within the compressor shell, under high evaporator pressure conditions, during periods of time when the suction modulation valve is in the closed position, is eliminated.

These and other features of the present invention can be best understood from the following specification and drawings, the following of which is a brief description.

DETAILED DESCRIPTION OF THE PREFERRED EMBODIMENTS

Figure 1:
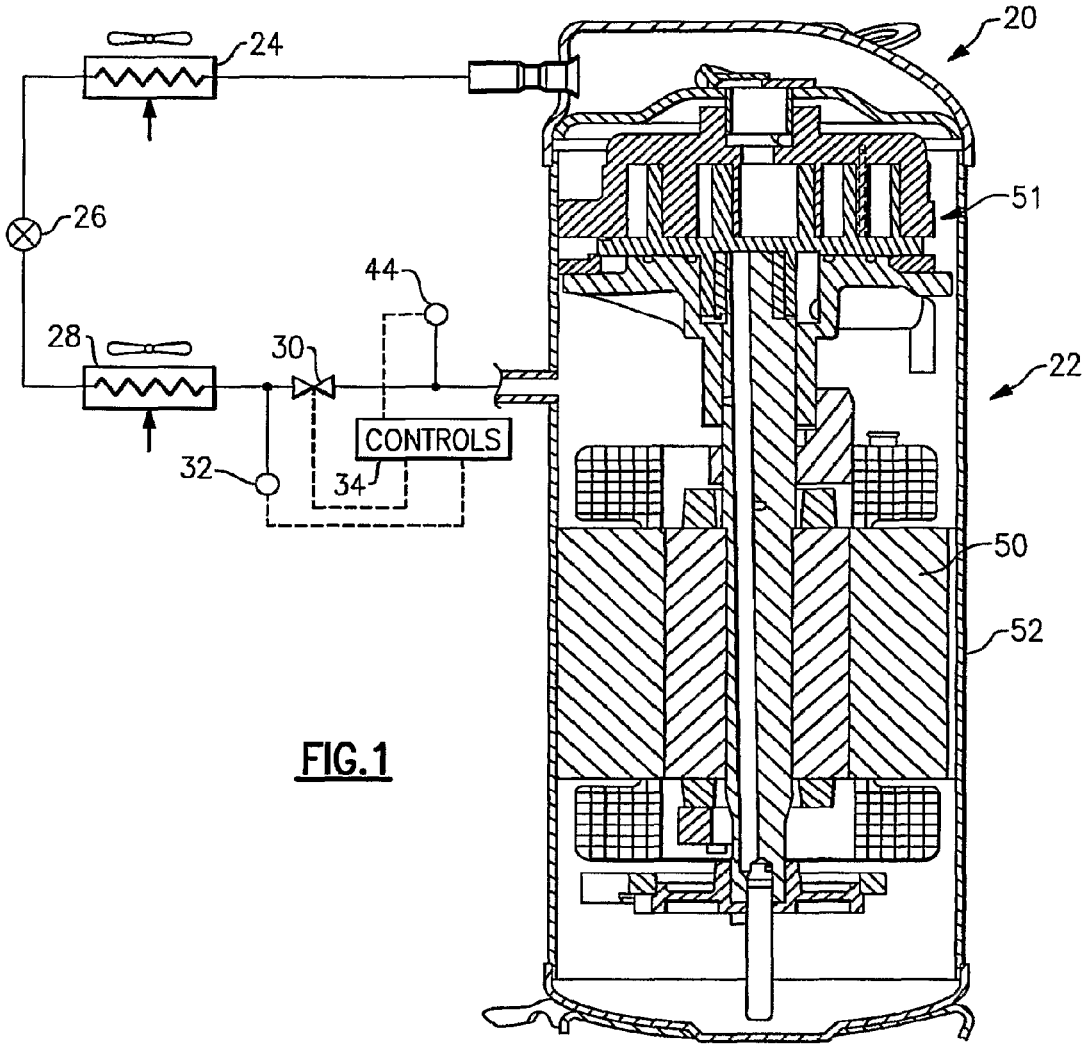
FIG. 1 is a schematic view of a refrigerant system incorporating the present invention.

A refrigerant system 20 is illustrated in FIG. 1. The refrigerant system 20 incorporates a compressor 22 compressing refrigerant and delivering it downstream to a condenser 24. Refrigerant from the condenser 24 passes through an expansion device 26, and then to an evaporator 28. Refrigerant from the evaporator 28 passes through a suction modulation valve 30 and back to the compressor 22. As is known, a control 34 for the suction modulation valve 30 may provide a pulse width modulation control to rapidly change the size of the opening through the valve 30 between open and closed positions, in order to limit the amount of refrigerant passing from the evaporator 28 to the compressor 22. In this manner, a reduced capacity during part-load operation for the refrigerant system 20 can be achieved.

Figure 2:
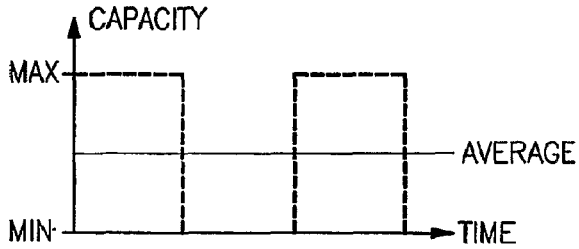
FIG.2 Prior Art
FIG. 2 shows the operation of a pulse width modulation control in the prior art.

As shown in FIG. 2, the refrigerant system capacity is cycled between a maximum (fully open suction modulation valve) and minimum value (suction modulation valve closed with a minimum opening) over time, such that the average capacity is less than the full-load capacity without the pulse width modulation control.

Figure 3A:
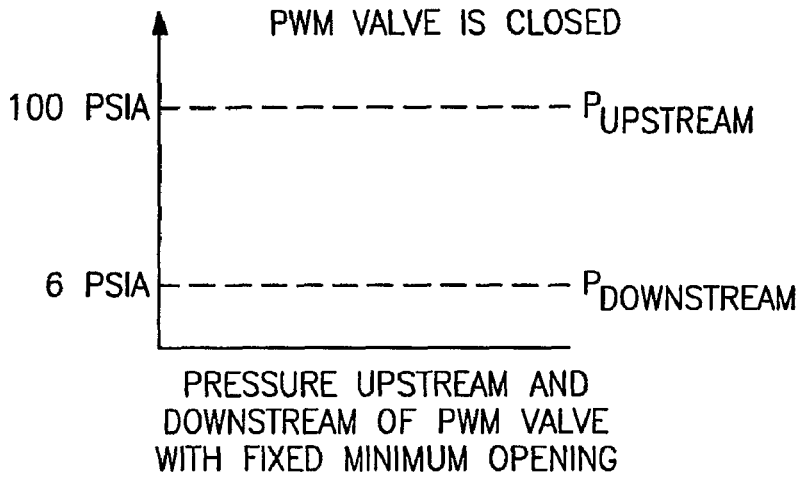
FIG. 3A and FIG. 3B show a problem with the prior art systems.
Figure 3B:
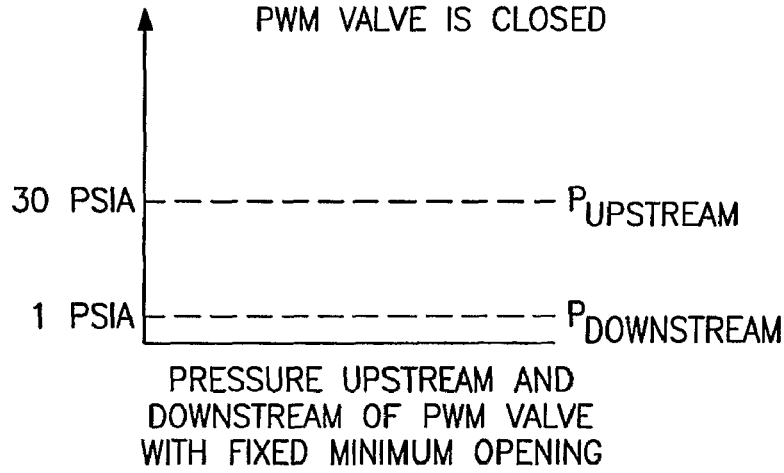

FIG. 3A and FIG. 3B explain shortcomings in the prior art. As mentioned above, some "leakage" path is typically maintained across the suction modulation valve to ensure that a relatively small amount of refrigerant does reach the compressor 22, and such that a minimum suction pressure is maintained within a compressor shell 52. As explained above, a motor 50 for a compressor pump unit 51 is received within the compressor shell 52. If the pressure within the compressor shell 52 becomes unduly low, then a "corona discharge" effect can occur, which is undesirable. For this reason, a refrigerant "leakage" path is typically provided to prevent the compressor from entering into a deep vacuum region. However, the size of this minimum "leakage" path has typically been designed to ensure that the pressure will never drop below the specified minimum pressure (e.g., 1 psia) for all operating conditions. For example, if the minimum expected upstream pressure, $P_{UPSTREAM}$, is equal to 30 psia, then the size of the minimum opening is designed to be such that the downstream pressure, $P_{DOWNSTREAM}$, at the suction modulation valve closed position, is at 1 psia, as shown in FIG. 3B. However, at 100 psia $P_{UPSTREAM}$ pressure value, for the same amount of opening for the suction modulation valve 30, the $P_{DOWNSTREAM}$ is about 6 psia, as shown in FIG. 3A, even though, for the most efficient operation, it would have been desirable to also have 1 psia pressure downstream of the suction modulation valve.

Figure 4:
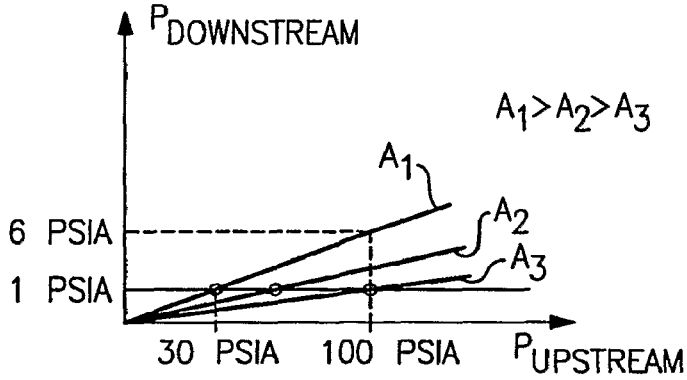
FIG. 4 is a chart explaining the feature of the present invention.

FIG. 4 shows a chart of pressure downstream ($P_{DOWNSTREAM}$) of the suction modulation valve versus pressure upstream ($P_{UPSTREAM}$) of the suction modulation valve for three different minimum opening sizes through the pulse width modulation valve (e.g., opening A1, opening A2, and opening A3) when the valve is in the closed position. The larger the opening, the larger is the $P_{DOWNSTREAM}$ pressure for the same $P_{UPSTREAM}$ pressure. As indicated in FIG. 4, A1 is the largest minimum opening size, A3 is the smallest minimum opening size, and A2 minimum opening size falls between A1 and A3 opening sizes. As can be seen in FIG. 4, when the valve has the largest minimum opening size A1, the downstream pressure, $P_{DOWNSTREAM}$, is equal to 1 psia, when the upstream pressure, $P_{UPSTREAM}$, is equal to 30 psia. Further, for the same opening A1, $P_{DOWNSTREAM}$ is equal to 6 psia, when $P_{UPSTREAM}$ is equal to 100 psia. However, what is desirable is to have 1 psia downstream pressure, $P_{DOWNSTREAM}$, regardless of the upstream pressure $P_{UPSTREAM}$. This $P_{DOWNSTREAM}$ pressure of 1 psia can be achieved by having the adjustable minimum suction modulation valve opening, namely the minimum suction modulation valve opening needs to be at A1, when $P_{UPSTREAM}$ pressure is equal to 30 psia, and the minimum suction modulation valve opening needs to be at A3, when $P_{UPSTREAM}$ pressure is equal to 100 psia.

As can be appreciated from FIG. 1, a pressure sensor 32 can be positioned upstream of the suction modulation valve 30 to measure the upstream pressure, $P_{UPSTREAM}$. Another sensor 44, can be positioned downstream of the suction modulation valve 30 to measure the pressure downstream of the suction modulation valve 30, $P_{DOWNSTREAM}$ (this downstream pressure corresponds to and typically closely approximates the suction pressure inside the compressor shell). From the graph in FIG. 4, a desired area "A" of the minimum suction modulation valve opening, which provides a desired 1 psia minimum downstream pressure, $P_{DOWNSTREAM}$, while the suction modulation valve is in the closed position, can be selected. It has to be noted that exemplary FIG. 4 only shows three curves for different area "A" openings, and a more precise graph is to be developed with a larger number of more closely spaced lines corresponding to areas "A", such that the desired area "A" can be accurately selected by interpolating between the lines corresponding to areas shown on this graph. The control 34 thus not only drives the suction modulation valve 30 to have a pulse width modulation movement between opened and closed positions, but also adjusts the minimum opening for the suction modulation valve 30 depending on operating conditions (and the pressure upstream $P_{UPSTREAM}$ of the suction modulation valve 30, in particular) to maintain 1 psia $P_{DOWNSTREAM}$ pressure regardless of the upstream pressure $P_{UPSTREAM}$. Thus, the pressure within the compressor shell 52 can always to be maintained close to the minimum pressure (e.g., 1 psia), rather than being higher then desired, causing irreversible efficiency losses in operation of the refrigerant system 20.

Instead of developing a graph as shown in FIG. 4, the refrigerant system 20 can have a feedback control, where the amount of minimum opening for the pulse modulation valve 30 can be adjusted based on pressure detected by a sensor 44, that is measuring the downstream pressure $P_{DOWNSTREAM}$. If the sensor 44 measures the value of $P_{DOWNSTREAM}$ to be substantially higher than 1 psia, when the pulse width modulation valve 30 is in the closed position, then the minimum opening size for the pulse width modulation valve 30 is reduced. In case the downstream pressure, $P_{DOWNSTREAM}$, is trending to drop below 1 psia, then the minimum opening size for the suction modulation valve 30 is increased. The control 34 can also operate in a learning mode, or in a mode when it learns what amount of opening is needed to maintain the downstream pressure $P_{DOWNSTREAM}$ nearing the vicinity of 1 psia, with respect to the upstream pressure $P_{UPSTREAM}$.

The graph presented in FIG. 4 is exemplary and shown for illustration purpose only, as the exact shape of the curves would depend on the particular compressor size and type, refrigerant type, etc. In addition to relying on the measurement of upstream pressure, $P_{UPSTREAM}$, other parameters can be measured to fine tune the establishment of the required minimum opening area of the pulse width modulation valve 30 in the closed position (such as temperature upstream and downstream of the valve, etc.). While a scroll compressor is used to illustrate this invention, other compressor types would fall within the scope of the invention, including, for example, rotary, screw, and reciprocating compressors. This invention can be applied to various types of systems and can include refrigeration container and truck-trailer systems, supermarket installations, residential air conditioning and heat pump systems, and rooftop units. Lastly, as mentioned above, other valve types capable to adjust minimum opening size would be within the scope and can equally benefit from the invention.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor, said compressor delivering refrigerant to a first heat exchanger, refrigerant passing form said first heat exchanger through an expansion device and to a second heat exchanger, refrigerant passing from said second heat exchanger through a suction valve and back to said compressor; and a control for said suction valve, said control operable to rapidly cycle said suction valve between open and closed positions to adjust the capacity of the refrigerant system, and said suction valve maintaining a minimum opening area in the closed position, said control selecting said minimum opening area to ensure a pressure within a shell for said compressor approximates a minimum predetermined pressure when said control has moved said suction valve to its closed position.

2. The refrigerant system as set forth in claim 1, wherein said suction valve is a suction modulation valve.

3. The refrigerant system as set forth in claim 1, wherein said minimum pressure is between 0.5 psia and 3 psia.

4. The refrigerant system as set forth in claim 1, wherein said minimum opening is selected by said control based on pressure associated with said second heat exchanger.

5. The refrigerant system as set forth in claim 4, wherein said pressure is measured at a location downstream of said second heat exchanger, and upstream of said suction valve.

6. The refrigerant system as set forth in claim 4, wherein a relationship is determined between said pressure and said minimum opening for said suction valve to ensure that the pressure within said compressor shell approximates the minimum pressure, and said relationship being utilized by said control to select said minimum opening.

7. The refrigerant system as set forth in claim 1, wherein said minimum opening is selected by said control based on pressure measurements indicative of said pressure within said compressor shell.

8. The refrigerant system as set forth in claim 7, wherein said control decreases said minimum opening if the said pressure within said compressor shell is higher than desired.

9. The refrigerant system as set forth in claim 7, wherein said control increases said minimum opening if the said pressure within said compressor shell is lower than desired.

10. A method of operating refrigerant system comprising the steps of:

(1) providing a compressor, said compressor delivering refrigerant to a first heat exchanger, refrigerant passing form said first heat exchanger through an expansion device and to a second heat exchanger, refrigerant passing from said second heat exchanger through a suction valve and back to said compressor; and (2) rapidly cycling said suction valve between open and closed positions to adjust the capacity of the refrigerant system, and said suction valve maintaining a minimum opening area in the closed position, said control selecting said minimum opening area to ensure a pressure within a shell for said compressor approximates a minimum predetermined pressure when said control has moved said suction valve to its closed position.

11. The method as set forth in claim 10, wherein said suction valve is a suction modulation valve.

12. The method as set forth in claim 10, wherein said minimum pressure is between 0.5 psia and 3 psia.

13. The method as set forth in claim 10, wherein said minimum opening is selected by said control based on pressure associated with said second heat exchanger.

14. The method as set forth in claim 13, wherein said pressure is measured at a location downstream of said second heat exchanger, and upstream of said suction valve.

15. The method as set forth in claim 13, wherein a relationship is determined between said pressure and said minimum opening for said suction valve to ensure that the pressure within said compressor shell approximates the minimum pressure, and said relationship being utilized by said control to select said minimum opening.

16. The method as set forth in claim 10, wherein said minimum opening is selected by said control based on pressure measurements indicative of said pressure within said compressor shell.

17. The method as set forth in claim 16, wherein said control decreases said minimum opening if the said pressure within said compressor shell is higher than desired.

18. The method as set forth in claim 17, wherein said control increases said minimum opening if the said pressure within said compressor shell is lower than desired.

* * * * *